US009658577B2

(12) United States Patent
Kakehi et al.

(10) Patent No.: US 9,658,577 B2
(45) Date of Patent: May 23, 2017

(54) IMAGE FORMING APPARATUS HAVING TRANSFER BELT ROLLERS OF SPECIFIC SHAPES

(71) Applicant: CANON KABUSHIKI KAISHA, Tokyo (JP)

(72) Inventors: Yutaka Kakehi, Kashiwa (JP); Hiroshi Kokubo, Kashiwa (JP); Haruhiko Omata, Abiko (JP); Takashi Fujita, Kashiwa (JP); Hideaki Kosasa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/676,035

(22) Filed: Apr. 1, 2015

(65) Prior Publication Data

US 2015/0286166 A1 Oct. 8, 2015

(30) Foreign Application Priority Data

Apr. 2, 2014 (JP) ..... 2014-076284
Jan. 23, 2015 (JP) ..... 2015-011256
Feb. 25, 2015 (JP) ..... 2015-034920

(51) Int. Cl.
*G03G 15/16* (2006.01)

(52) U.S. Cl.
CPC ..... *G03G 15/1605* (2013.01); *G03G 15/167* (2013.01); *G03G 2215/1623* (2013.01)

(58) Field of Classification Search
CPC ..... G03G 15/1615; G03G 15/1605–15/161
USPC ..... 399/312, 313
See application file for complete search history.

(56) References Cited

U.S. PATENT DOCUMENTS 5,465,146 A * 11/1995 Higashi ..... G02B 15/161 399/328
6,408,158 B1 * 6/2002 Takahata ..... G03G 9/0821 399/302

(Continued)

FOREIGN PATENT DOCUMENTS

CN 101598922 A 12/2009
CN 102667637 A 9/2012

(Continued)

OTHER PUBLICATIONS

Extended European Search Report in European Patent Application No. 15162206.5, dated Oct. 1, 2015.

(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus includes: an image bearing member; a toner image forming unit; an endless transfer belt; a transfer roller urged from an inner peripheral surface of the transfer belt toward the image bearing member via the transfer belt; a feeding surface forming roller, provided downstream of the transfer roller with respect to a traveling direction of the transfer belt, having such a shape that a diameter at each of end portions is smaller than a diameter at a central portion with respect to a rotational axis direction; and a stretching roller, downstream of the feeding surface forming roller with respect to the traveling direction of the transfer belt, having such a shape that a diameter at each of end portions is larger than a diameter at a central portion with respect to the rotational axis direction.

8 Claims, 11 Drawing Sheets

(56) References Cited

U.S. PATENT DOCUMENTS

| | | | | |
|---|---|---|---|---|
| 8,320,791 | B2 | 11/2012 | Mochizuki | |
| 8,494,432 | B2 | 7/2013 | Kakehi | |
| 8,577,268 | B2 | 11/2013 | Torimaru | |
| 8,626,014 | B2 | 1/2014 | Kakehi | |
| 8,838,012 | B2 | 9/2014 | Torimaru | |
| 2011/0097096 | A1* | 4/2011 | Sueoka | G03G 15/1605 399/49 |
| 2011/0135354 | A1 | 6/2011 | Maruko et al. | |
| 2011/0142502 | A1* | 6/2011 | Torimaru | 399/312 |
| 2011/0249993 | A1 | 10/2011 | Nakamura et al. | |
| 2015/0284197 | A1* | 10/2015 | Shigihara | B65H 5/025 271/277 |
| 2015/0286165 | A1* | 10/2015 | Suzuki | G03G 15/1685 399/313 |

FOREIGN PATENT DOCUMENTS

| | | | |
|---|---|---|---|
| EP | 2 012 518 | A2 | 1/2009 |
| JP | 07-225523 | A | 8/1995 |
| JP | 10-20716 | A | 1/1998 |
| JP | 2001-356564 | A | 12/2001 |
| JP | 2011-059259 | A | 3/2011 |
| JP | 2011-123254 | A | 6/2011 |
| JP | 2011-123417 | A | 6/2011 |
| JP | 2012-128228 | A | 7/2012 |
| JP | 2013-097092 | A | 5/2013 |

OTHER PUBLICATIONS

Office Action dated Jan. 25, 2017, in Chinese Patent Application No. 201510150567.1.

* cited by examiner (a)

(b)

IMAGE FORMING APPARATUS HAVING TRANSFER BELT ROLLERS OF SPECIFIC SHAPES

FIELD OF THE INVENTION AND RELATED ART

The present invention relates to an image forming apparatus for transferring a toner image, carried on an image bearing member, onto a recording material carried on a transfer belt.

As described in Japanese Laid-Open Patent Application (JP-A) 2012-128228, an image forming apparatus, in which the recording material is carried on the transfer belt and is passed through a transfer portion, where the toner image carried on an intermediary transfer belt which is an example of the image bearing member is transferred onto the recording material carried on the transfer belt, has been widely used.

In the image forming apparatus using the transfer belt, in the case where a low-rigidity recording material such as thin paper or a wavy and deformed recording material is passed through the transfer portion and the toner image is transferred onto the recording material, creases may be generated on the recording material in some cases.

Therefore, a constitution in which a transfer roller having an outer peripheral surface which has such a reverse crown shape that a diameter gradually increases from a central portion toward each of end portions is press-contacted to the image bearing member via the transfer belt was proposed. As described in JP-A Hei 7-225523, a transfer roller having the reverse crown shape at the outer peripheral surface presses and extends a trailing end portion of the recording material passing through the transfer portion since a feeding speed at an end portion is higher than a feeding speed at a central portion with respect to the rotational axis direction. As a result, a smoothing-down effect on the creases at both end portions and the trailing end portion of the recording material with respect to a recording material feeding direction is achieved, so that there is a possibility that generation of the creases of the recording material at the end portions and the central portion of the recording material with respect to the recording material feeding direction can be prevented or alleviated.

As described later, in an image forming apparatus in which the transfer roller was press-contacted to an inside surface of the transfer belt and thus the transfer portion of the toner image was formed, an experiment that the reverse crown shape was imparted to the transfer roller and then the smoothing-down effect on the creases of the recording material was checked was conducted (Table 2 appearing later). As a result, in the case where the transfer roller was press-contacted to the inside surface of the transfer belt, it turned out that even when the reverse crown shape was imparted to the transfer roller, the smoothing-down effect on the creases of the recording material during passing of the recording material through the transfer portion was not completely effective.

SUMMARY OF THE INVENTION

According to an aspect of the present invention, there is provided an image forming apparatus comprising: an image bearing member; a toner image forming unit for forming a toner image on the image bearing member; an endless transfer belt for feeding a recording material; a transfer roller, urged from an inner peripheral surface of the transfer belt toward the image bearing member via the transfer belt, for forming a transfer portion for transferring the toner image from the image bearing member onto the recording material; a feeding surface forming roller for stretching the transfer belt to form a recording material feeding surface, wherein the feeding surface forming roller is provided downstream of the transfer roller with respect to a traveling direction of the transfer belt and has such a shape that a diameter at each of end portions is smaller than a diameter at a central portion with respect to a rotational axis direction; and a stretching roller for stretching the transfer belt, wherein the stretching roller is provided downstream of the feeding surface forming roller with respect to the traveling direction of the transfer belt and has such a shape that a diameter at each of end portions is larger than a diameter at a central portion with respect to the rotational axis direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings.

<First Embodiment>

(Image Forming Apparatus)

Figure 1:
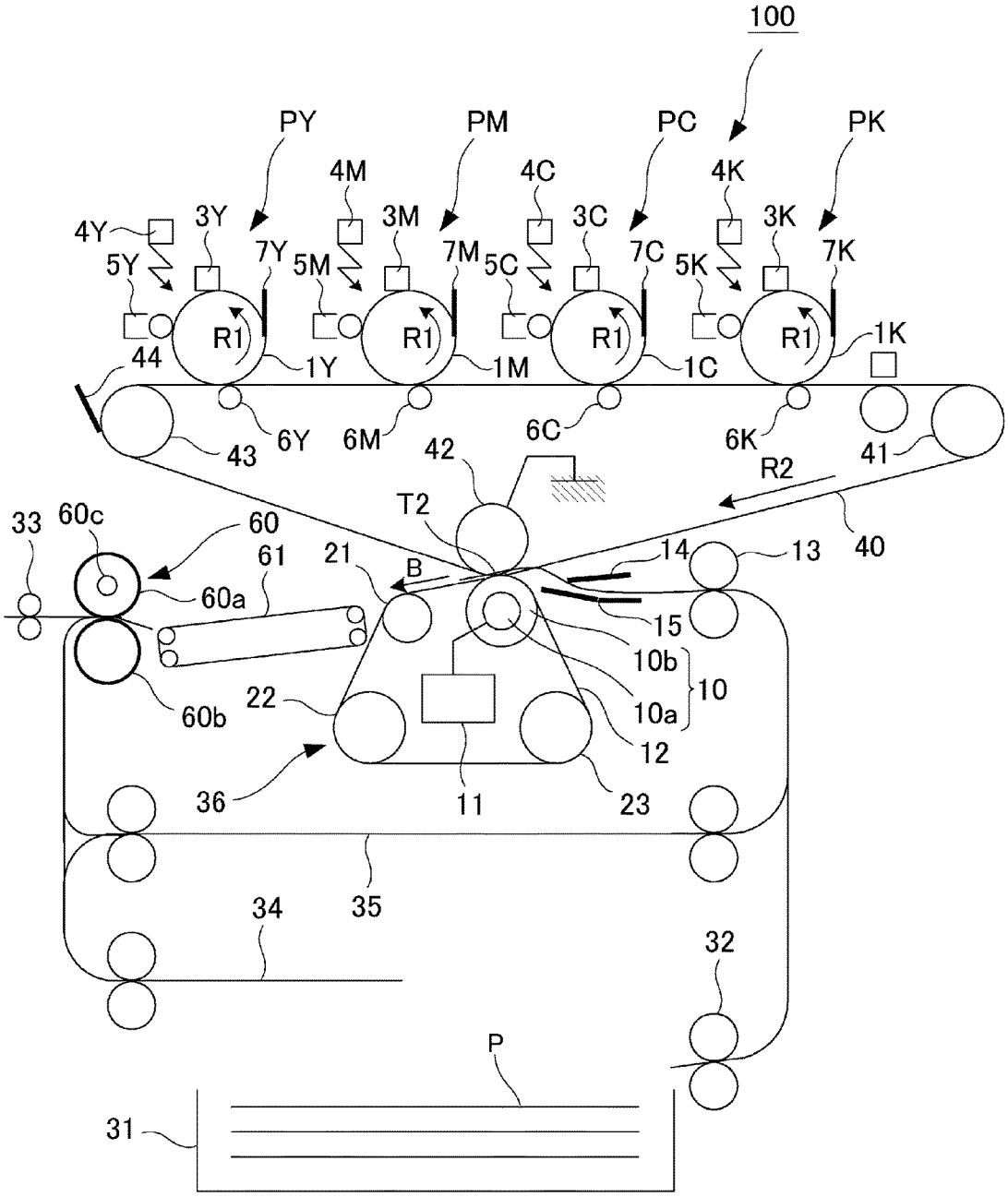
FIG. 1 is an illustration of a structure of an image forming apparatus in First Embodiment.

FIG. 1 is an illustration of a structure of an image forming apparatus 100. As shown in FIG. 1, the image forming apparatus 100 is an intermediary transfer type full color printer of a tandem type in which image forming portions PY, PM, PC and PK as process cartridges are arranged along an upward surface of an intermediary transfer belt 40.

At the image forming portion PY, a yellow toner image is formed on a photosensitive drum 1Y and then is primary-transferred onto the intermediary transfer belt 40. At the image forming portion PM, a magenta toner image is formed on a photosensitive drum 1M and then is primary-transferred onto the intermediary transfer belt 40. At the image forming portions PC and PK, cyan and black toner images are formed on photosensitive drums 1C and 1K, respectively, and then are primary-transferred onto the intermediary transfer belt 40.

The four color toner images transferred on the intermediary transfer belt 40 are fed to a secondary transfer portion T2, and are secondary transferred onto a recording material P. The recording material P is taken out from a recording material cassette 31, and is separated one by one by a separation roller 32, and then is fed to a registration roller pair 13. The registration roller pair 13 sends the recording material P to the secondary transfer portion T2 while timing the recording material P to the toner images on the intermediary transfer belt 40.

A secondary transfer belt unit 36 is contacted to the intermediary transfer belt 40 supported by an inner secondary transfer roller 42 at an inside surface of the intermediary transfer belt 40, so that the secondary transfer portion T2 is formed. By applying a voltage to a secondary transfer roller 10, the toner images are secondary-transferred from the intermediary transfer belt 40 onto the recording material being fed through the secondary transfer portion T2. Each of the toner images transferred on the recording material P has a maximum reflection density of about 1.5-1.7. At the maximum reflection density, a toner amount per unit area of each of the toner images is about 0.4 $mg/cm^2$-0.6 $mg/cm^2$.

The recording material P on which the four color toner images are secondary transferred is fed into a fixing device 60 by being fed by a pre-feeding device 61 for the fixing device 60, and then is heated and pressed by the fixing device 60, so that the toner images are fixed on the surface of the recording material P. The fixing device 60 melts and fixes the toner images on the recording material P by applying predetermined pressure and predetermined heat quantity to the recording material P in a nip formed by a fixing roller 60*a*, in which a heater 60*c* is provided, and a pressing roller 60*b*.

(Double-side Printing Mode)

In an operation in a double-side printing mode, the recording material P passed through the fixing device 60 is discharged as it is to an outside of the image forming apparatus 100 through a discharging roller pair 33. On the other hand, in the operation in the double-side printing mode, image formation is effected on both surfaces of the recording material P by feeding the recording material P again to the secondary transfer portion T2 so that a second surface (back surface) of the recording material P on which the toner images are fixed once to a first surface (front surface) of the recording material P is directed upward as an image forming surface. In the operation in the double-side printing mode, the image formation is effected on both surfaces of the recording material P, so that a degree of consumption of the recording material P can be suppressed.

In the operation in the double-side printing mode, the recording material P passed through the fixing device 60 is sent to a reverse feeding path 34, in which a switch-back operation is performed in the reverse feeding path 34, so that the recording material P is turned upside down and then is fed to a feeding path 35 for the double-side printing. The feeding path 35 for the double-side printing merges the recording material P with the registration roller pair 13, and then the recording material P is fed again to the secondary transfer portion T2. The recording material P on which the four color toner images are secondary-transferred and fixed also on the back surface (second surface) thereof is discharged to the outside of the image forming apparatus 100 through the discharging roller pair 33. In the operation in the double-side printing mode, as described later, creases are liable to generate on the recording material P during second-time secondary transfer of the toner images.

(Image Forming Portion)

As shown in FIG. 1, the image forming portions PY, PM, PC and PK have the substantially same constitution except that colors of toners used in developing devices 5Y, 5M, 5C and 5K are yellow, magenta, cyan and black, respectively, which are different from each other. In the following, the image forming portion PY (for yellow) is described, and redundant explanation about the image forming portions PM, PC and PK will be omitted.

The image forming portion PY includes, at a periphery of the photosensitive drum 1Y, a charging device 3Y, an exposure device 4Y, the developing device 5Y, a primary transfer roller 6Y and drum cleaning device 7Y. The photosensitive drum 1Y is prepared by forming a photosensitive layer on an outer peripheral surface of an aluminum cylinder, and rotates in an arrow R1 direction at a predetermined process speed.

The charging device 3Y electrically charges the surface of the photosensitive drum 1Y to a uniform negative potential. The exposure device 3Y scans the surface of the photosensitive drum 1Y with a laser beam, through a rotating mirror, which is generated based on an image signal obtained by developing image data on a scanning line, so that an electrostatic image for an image is written (formed) on the surface of the photosensitive drum 1Y. The developing device 5Y develops the electrostatic image into the toner image by transferring the toner on the photosensitive drum 1Y. An unshown developer supplying portion supplies the toner, in an amount corresponding to an amount of the toner taken out from the developing device 5Y with the image formation, to the developing device 5Y.

The primary transfer roller 6Y presses the intermediary transfer belt 40 to form a primary transfer portion between the photosensitive drum 1Y and the intermediary transfer belt 40. When a positive DC voltage is applied to the primary transfer roller 6Y, the negative toner image carried on the photosensitive drum 1Y is transferred onto the intermediary transfer belt 40. The drum cleaning device 7Y rubs the photosensitive drum 1Y with a cleaning blade, and thus collects a transfer residual toner deposited on the surface of the photosensitive drum 1Y.

As described above, at each of the image forming portions PY, PM, PC and PK which are an example of a toner image forming portion, the toner image is formed and carried on the intermediary transfer belt 40 which is an example of an image bearing member. The secondary transfer roller 10 which is an example of a transfer roller is press-contacted to the secondary transfer belt 12, which is an example of a transfer belt, toward the intermediary transfer belt 40.

(Intermediary Transfer Belt)

The intermediary transfer belt 40 is stretched by a driving roller 43, a tension roller 41 and the inner secondary transfer roller 42, and is driven by the driving roller 43, so that the intermediary transfer belt 40 is rotated in an arrow R2 direction at a speed of 250 mm/sec-300 mm/sec. The tension roller 41 is urged outwardly by an unshown urging spring at each of end portions thereof, so that tension of the intermediary transfer belt 40 is controlled at a substantially certain level. The inner secondary transfer roller 42 supports an inside surface of the intermediary transfer belt 40 passing through the secondary transfer portion T2. A belt cleaning device 44 rubs the intermediary transfer belt 40 with a cleaning blade, and thus collects a transfer residual toner from the surface of the intermediary transfer belt 40.

The intermediary transfer belt 40 is adjusted so that a volume resistivity thereof is $1\times10^{9}$ Ω·cm-$1\times10^{14}$ Ω·cm by adding carbon black as an antistatic agent in a proper amount into a resin material such as polyimide or polycarbonate or into various rubber materials or the like. The intermediary transfer belt 40 is 0.07 mm-0.1 mm in thickness.

(Upstream Guide)

A secondary transfer upstream-side upper guide 14 and a secondary transfer upstream-side lower guide 15 regulate a feeding path until the recording material P is fed from the registration roller pair 13 to the secondary transfer portion T2.

The secondary transfer upstream-side upper guide 14 regulates such a behavior that the recording material P approaches the surface of the intermediary transfer belt 40. The secondary transfer upstream-side upper guide 14 guides the recording material P in an upstream side of the secondary transfer portion T2, so that the recording material P is superposed on the surface of the intermediary transfer belt at a predetermined position.

The secondary transfer upstream-side lower guide 15 regulates such a behavior that the recording material P moves apart from the surface of the intermediary transfer belt 40. The secondary transfer upstream-side lower guide 15 guides the recording material P in the upstream side of the secondary transfer portion T2, so that the recording material P is superposed on the surface of the intermediary transfer belt at the predetermined position.

(Secondary Transfer Belt Unit)

Figure 2:
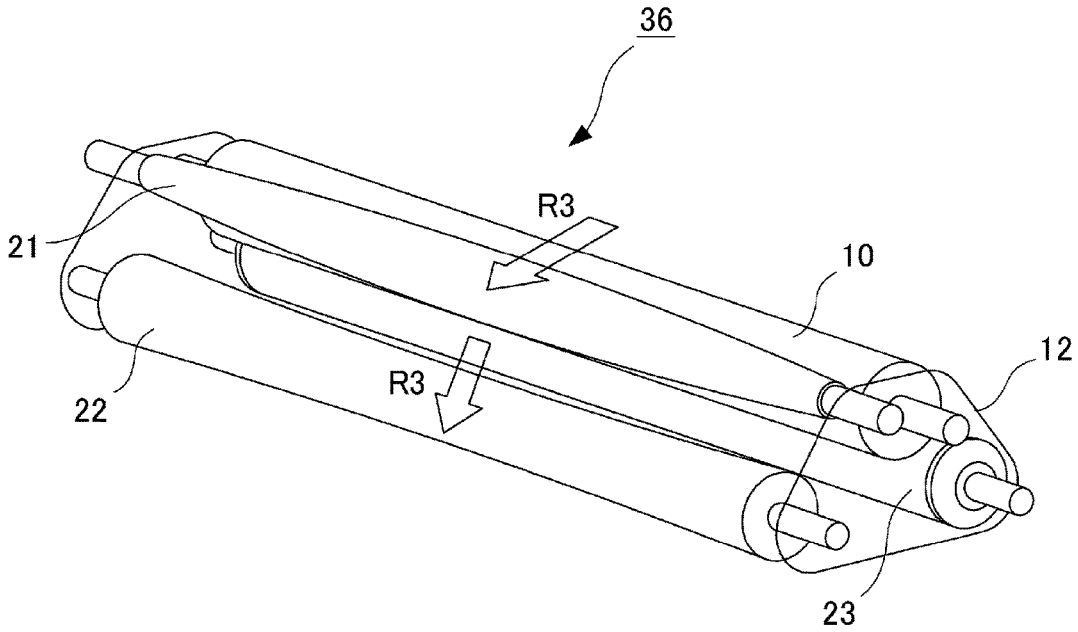
FIG. 2 is a perspective view of a secondary transfer belt unit.
Figure 3:
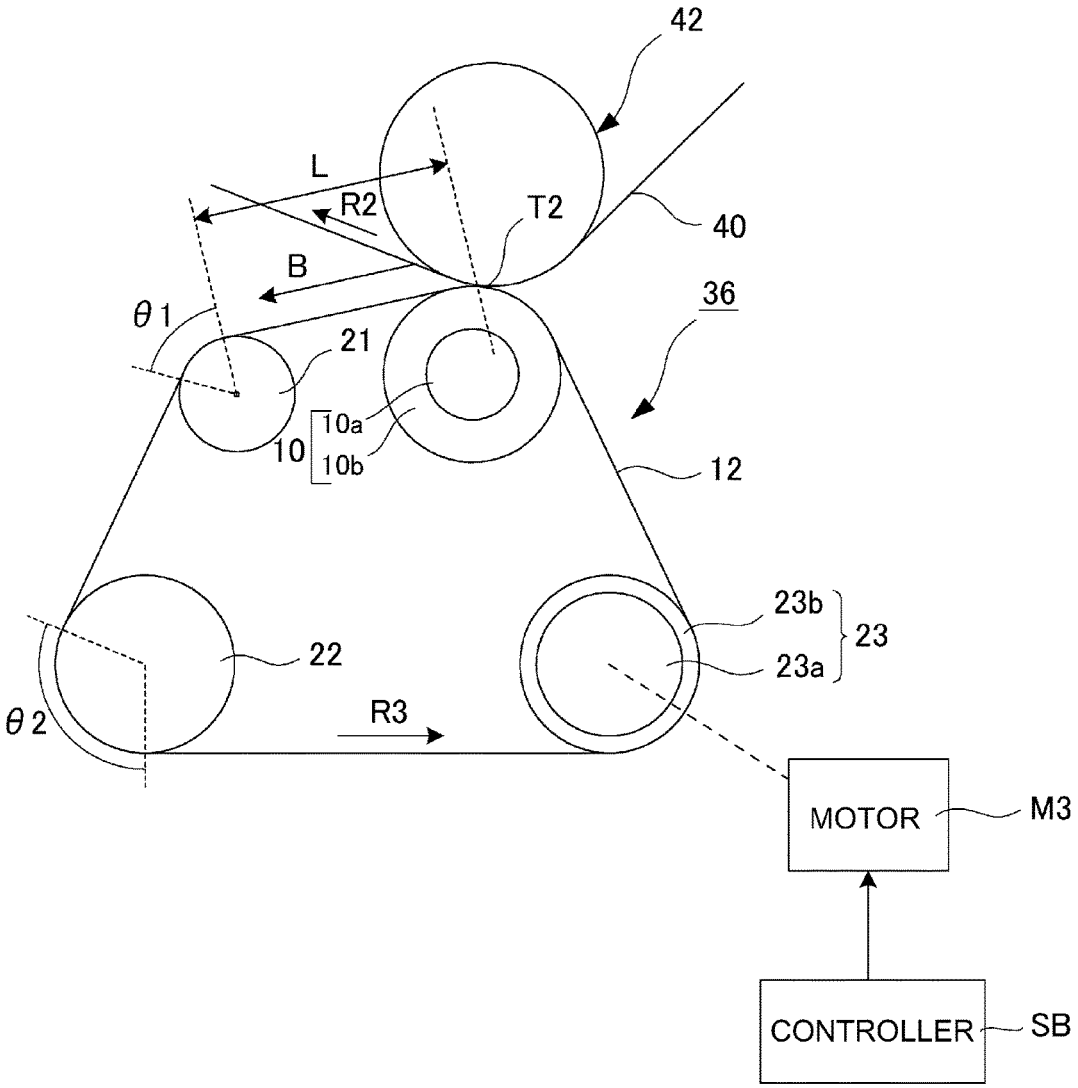
FIG. 3 is an illustration of a structure of the secondary transfer belt unit.

FIG. 2 is a perspective view of the secondary transfer belt unit 36. FIG. 3 is an illustration of a structure of the secondary transfer belt unit 36. As shown in FIG. 1, by using the secondary transfer belt 12, after the toner images are transferred at the secondary transfer portion T2, separation of the recording material P from the intermediary transfer belt 40 becomes easy, so that the recording material P can be stably fed to the fixing device 60.

As shown in FIG. 2, in the secondary transfer belt unit 36, the secondary transfer belt 12 is extended around and supported by four stretching rollers, i.e., the secondary transfer roller 10, a feeding surface forming roller 21, a stretching roller 22 and a driving roller 23. With respect to a rotational direction of the secondary transfer belt 12, the feeding surface forming roller 21 is provided downstream of the secondary transfer roller 10. The stretching roller 22 is provided downstream of the feeding surface forming roller 21. The driving roller 23 is provided downstream of the stretching roller 22. The secondary transfer roller 10 is provided downstream of the driving roller 23.

As shown in FIG. 3, the secondary transfer belt 12 is an endless belt member having a layer formed of a resin material or a metal material.

The secondary transfer belt 12 is formed of the resin material adjusted so that a volume resistivity thereof is $1\times10^{9}$ Ω·cm-$1\times10^{14}$ Ω·cm by adding carbon black as an antistatic agent in a proper amount into the resin material such as polyimide or polycarbonate. The secondary transfer belt 12 has a single-layer structure and is 0.07 mm-0.1 mm in thickness. The secondary transfer belt 12 is 100 MPa or more and less than 10 GPa in value of the Young's Modulus as measured according to a tensile test method (JIS K 6301).

(Secondary Transfer Roller)

As shown in FIG. 3, the secondary transfer roller 10 is formed with an outer diameter of 24 mm by providing an elastic layer 10*b* of an ion conductive foam rubber (NBR) on an outer peripheral surface of a core metal 10*a* of a stainless steel round bar. The elastic layer 10*b* of the secondary transfer roller 10 has a surface roughness Rz =6.0μm -12.0μm. A resistance value of the secondary transfer roller 10 as measured under application of a voltage of 2 KV in a normal temperature/normal humidity environment (N/N: 23° C./50%RH) is $1\times10^{5}$ Ω–$1\times10^{7}$ Ω. The elastic layer 10*b* has Asker-C hardness of about 30-40 degrees.

To the secondary transfer roller 10, a secondary transfer power source 11 capable of outputting a variable current is connected. The secondary transfer power source 11 automatically adjusts an output voltage so that a transfer current of +40 μA to +60 μA as an example flows. The secondary transfer power source 11 applies a voltage to the secondary transfer roller 10 to form a transfer electric field between the intermediary transfer belt 40 and the secondary transfer belt 12, so that the toner images carried on the intermediary transfer belt 40 are secondary-transferred onto the recording material P carried on the secondary transfer belt 12. The recording material P is attracted to the secondary transfer belt 12 by an electrostatic force supplied with the secondary transfer of the toner images.

The secondary transfer belt 12 rotates in an arrow B direction, so that the recording material P attracted to the surface of the secondary transfer belt 12 is fed from the secondary transfer portion T2 toward a downstream side.

The peripheral surface of the secondary transfer roller 10 has a normal crown shape of about 200 μm-300 μm. The reason why the normal crown shape is formed on the secondary transfer roller 10 is that flexure of the secondary transfer roller 10 is canceled and thus a decrease in pressure at a central portion of the secondary transfer portion T2 with respect to a rotational axis direction is prevented.

The secondary transfer belt 12 and the intermediary transfer belt 40 are supported by the inner secondary transfer roller 42, and therefore when the secondary transfer roller 10 is press-contacted to the secondary transfer belt 12 toward the inner secondary transfer roller 42 as shown in FIG. 1, the secondary transfer portion T2 has a flat shape with respect to the rotational axis direction. Even when the surface of the secondary transfer roller 10 is provided with the crown of about 200 μm-300 μm, the secondary transfer roller 10 is in a state in which the secondary transfer roller 10 is urged (pressed) by the secondary transfer belt 12 and the intermediary transfer belt 40, so that the secondary transfer roller 10 is flexed downward by about 200 μm-300 μm.

(Driving Roller)

As shown in FIG. 3, the driving roller 23 is driven by a motor M3, so that the secondary transfer belt 12 is rotated in an arrow R3 direction. A driving system for the secondary transfer belt 12 is provided independently of a driving system of the intermediary transfer belt 40 in order to enable adjustment of a speed difference between the secondary transfer belt 12 and the intermediary transfer belt 40. The driving roller 23 is prepared by fixing a thin rubber layer 23*b* on the peripheral surface of a metal roller 23*a* to ensure a frictional force with the secondary transfer belt 12, so that slip is prevented from generating between the secondary transfer belt 12 and the driving roller 23 during the drive.

The driving roller 23 is formed in a straight shape having an outer diameter of 20 mm-24 mm, and rotationally drives the secondary transfer belt 12. By pulling the secondary transfer belt 12 by the straight-shaped driving roller 23, the secondary transfer belt 12 can be hermetically contacted to the peripheral surfaces of the feeding surface forming roller 21 and the stretching roller 22. By forming the driving roller 23 in the straight shape, at the secondary transfer portion T2 positioned downstream of the driving roller 23, it is possible to prevent generation of transfer non-uniformity or the like, due to creases of the secondary transfer belt 12, by the reverse crown shape provided on the stretching roller 22.

As described above, the driving roller 23 which is an example of a driving roller drives the secondary transfer belt 12 in a downstream side of the stretching roller 22 with respect to the rotational direction of the secondary transfer belt 12. The driving roller 23 has the same diameter in an entire region where the driving roller 23 stretches the secondary transfer belt 12 with respect to the rotational axis direction.

(Feeding Surface Forming Roller)

Figure 4:
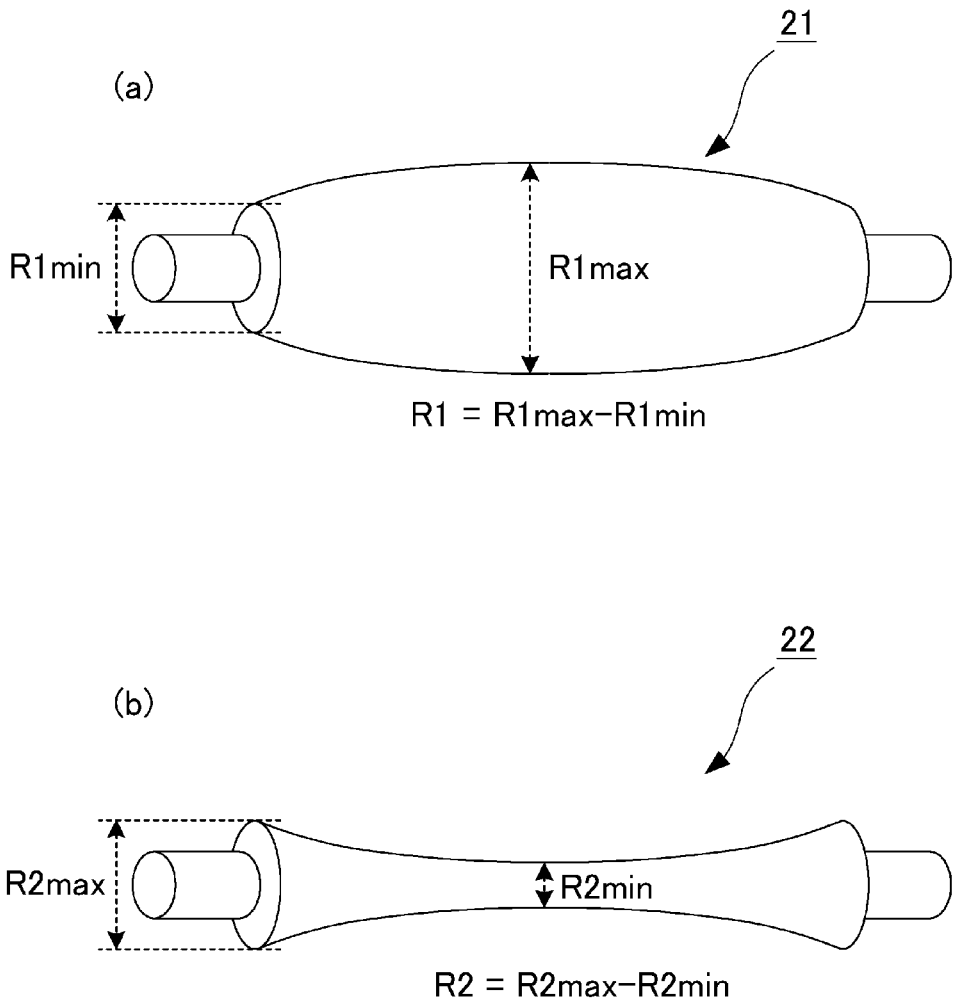
In FIG. 4, (a) and (b) are illustrations of crown shapes of a feeding surface forming roller and a stretching roller, respectively.

In FIG. 4, (a) and (b) are illustrations showing crown shapes of the feeding surface forming roller and the stretching roller. The feeding surface forming roller 21 has the peripheral surface where the normal crown shape is formed in order to prevent the creases generated in the recording material at the secondary transfer portion T2. An amount of the crown of the normal crown shape formed on the feeding surface forming roller 21 is larger than an amount of the crown formed on the secondary transfer roller 10.

As shown in FIG. 1, the feeding surface forming roller 21 is the stretching roller, for the secondary transfer belt 12, disposed downstream of the secondary transfer roller 10. The recording material P attracted to the surface of the secondary transfer belt 12 is separated from the surface of the secondary transfer belt 12 by curvature at a curved surface of the secondary transfer belt 12 along the feeding surface forming roller 21, and then is delivered to the pre-feeding device 61 for the fixing device.

As shown in (a) of FIG. 4, the feeding surface forming roller 21 is formed by cutting a stainless steel round bar, which is an example of a metal material, into such a normal crown shape that a central portion of the peripheral surface with respect to the rotational axis direction bulges in an amount larger than that at each of end portions of the peripheral surface with respect to the rotational direction. With respect to the rotational axis direction, an outer diameter of a portion having a largest outer diameter of the feeding surface forming roller 21 is R1max, and an outer diameter of a portion having a smallest outer diameter of the feeding surface forming roller 21 is R1min. Then, a difference in outer diameter between the portion having the largest outer diameter and the portion having the smallest outer diameter is defined as a normal crown amount ΔR1.

$$\Delta R1 = R1\max - R1\min$$

By an experiment, it was confirmed that a recording material crease eliminating effect at the secondary transfer portion T2 became larger with a larger normal crown amount ΔR1.

In First Embodiment, as shown in FIG. 3, a distance L from the secondary transfer portion T2 to the feeding surface forming roller 21 is set at 20 mm-30 mm, and the normal crown amount ΔR1 is set at 1 mm-3 mm. Further, the outer diameter R1min of the portion having the smallest outer diameter of the feeding surface forming roller 21 is set at 10 mm-16 mm.

The reason why a degree of the creases generated on the recording material P passing through the secondary transfer portion T2 becomes smaller with a larger normal crown amount ΔR1 of the feeding surface forming roller 21 would be considered as follows.

A contour along a rotational axis of the feeding surface forming roller 21 is curved outward from the end portions to the central portion with respect to the rotational axis direction. For this reason, the secondary transfer belt 12 guided by the contour of the feeding surface forming roller 21 in the downstream side of the secondary transfer portion T2 is deformed together with the recording material P carried thereon so as to be curved outward from the end portions to the central portion with respect to the rotational axis direction. With such deformation of the secondary transfer belt 12, such a force that a degree of floating of the recording material P from the secondary transfer belt 12 in an upstream side of the secondary transfer portion T2 is decreased acts on the recording material P passing together with the secondary transfer belt 12 through the secondary transfer portion T2. Further, with such deformation of the secondary transfer belt 12, a force in a direction in which end portions of the recording material with respect to a widthwise direction are shifted toward a central portion in the downstream side of the secondary transfer portion T2 and in which a trailing end portion of the recording material P extends toward an outside with respect to the widthwise direction in the upstream side of the secondary transfer portion T2 acts on the recording material P. Those forces realize a crease smoothing-down effect at the central portion and the trailing end portion of the recording material P with respect to the widthwise direction.

Further, in the downstream side of the secondary transfer portion T2, when the recording material P is deformed so as to be convexed (curved) outward (upward), in the upstream side of the secondary transfer portion T2 where the recording material P is nipped in a straight shape, such a force that the recording material P is curved downward acts on the recording material P in action to the portion curved upward in the downstream side. When such a force that the recording material P is curved downward acts on the recording material P in the upstream side of the secondary transfer portion T2, the force not only causes the creases at the secondary transfer portion T2 but also decreases a degree of wavy floating of the recording material P. For this reason, the feeding surface forming roller 21 is formed in such a shape that the central portion of the secondary transfer belt 12 with respect to the rotational axis direction can be deformed so as to be curved upward (outward) in an amount larger than that at the end portions, whereby the degree of the creases generating at the secondary transfer portion T2 can be alleviated. In the upstream side of the secondary transfer portion T2, a crease-smoothing-down force efficiently acts on the recording material P at the secondary transfer portion T2, so that an image defect due to the generation of the creases at the secondary transfer portion T2 resulting from the waving and the floating of the recording material P can be prevented.

The shape in which the central portion of the feeding surface forming roller 21 with respect to the rotational axis direction deforms the secondary transfer belt 12 so as to curve outward in the amount larger than that at the end portions is not limited to the normal crown shape. The shape can be replaced with another shape having a contour line, along the rotational axis, such that the secondary transfer belt 12 at a portion ranging from the secondary transfer portion T2 to the feeding surface forming roller 21 is curved outward from the end portions to the central portion with respect to the widthwise direction of the secondary transfer belt 12.

Further, in the case where the normal crown shape is formed on the feeding surface forming roller 21, the normal crown shape is not limited to a normal crown shape having a contour line changing in such a manner that a diameter of the feeding surface forming roller 21 changes in a parabolic function manner along the rotational axis. The shape having the contour line along the rotational axis may also be a hyperbola shape, a catenary shape, an arcuate shape, an elliptical shape, or the like.

As described above, the feeding surface forming roller 21 which is an example of a feeding surface forming roller forms a recording material feeding surface by stretching the secondary transfer belt 12 at a position to which a leading end of the recording material P, with respect to a recording material feeding direction, fed through the secondary transfer portion T2 can reach. At each of the end portions with respect to the rotational axis direction, the feeding surface forming roller 21 has a region where the secondary transfer belt 12 is stretched in a diameter smaller than a diameter at the central portion.

(Stretching Roller)

The crease eliminating effect of the feeding surface forming roller 21 on the recording material P carried on the secondary transfer belt 12 decreases unless the secondary transfer belt 12 feeding the recording material P is tightly stretched by being hermetically contacted to the peripheral surface of the feeding surface forming roller 21 having the normal crown shape. The secondary transfer belt 12 is formed of the recording material and has a property of being hard, and therefore it is not easy to cause the secondary transfer belt 12 to be hermetically contacted to the peripheral surface of the feeding surface forming roller 21 having the normal crown shape.

Therefore, in this embodiment, the stretching roller 22 having the reverse crown shape on the peripheral surface thereof is provided downstream of the feeding surface forming roller 21. The peripheral surface of the stretching roller 22 having the reverse crown shape pulls the secondary transfer belt 12 without excess and deficiency along the peripheral surface of the feeding surface forming roller 21 having the normal crown shape, so that the secondary transfer belt 12 can be hermetically contacted to the peripheral surface of the feeding surface forming roller 21 having the normal crown shape.

Without generating a gap between the secondary transfer belt and each of the end portions of the feeding surface forming roller 21 having the normal crown shape, on the feeding surface forming roller 2, the secondary transfer belt 12 can be deformed so that the central portion of the secondary transfer belt 12 with respect to the widthwise direction is curved outward. Even when the secondary transfer belt 12 is formed of a hard resin material, the secondary transfer belt 12 is hermetically contacted to the feeding surface forming roller 21 having the normal crown shape in a region ranging from one of the end portions to the other end portion, so that the secondary transfer belt 12 can be deformed along the contour of the normal crown shape of the feeding surface forming roller 21. As a result, it is possible to sufficiently achieve the crease generation suppressing effect when the recording material P on the secondary transfer belt 12 passes through the secondary transfer portion T2.

As shown in (b) of FIG. 4, the stretching roller 22 is formed by cutting a stainless steel round bar, which is an example of a metal material, into such a reverse crown shape that each of end portions of the stretching roller 22 with respect to the rotational axis direction thickens in an amount larger than that at a central portion of the stretching roller 22 with respect to the rotational direction. With respect to the rotational axis direction, an outer diameter of a portion having a largest outer diameter of the stretching roller 22 is R2max, and an outer diameter of a portion having a smallest outer diameter of the stretching roller 22 is R2min. Then, a difference in outer diameter between the portion having the largest outer diameter and the portion having the smallest outer diameter is defined as a reverse crown amount ΔR2.

$$\Delta R2 = R2\text{max} - R2\text{min}$$

In this embodiment, the outer diameter R2min of the portion having the smallest outer diameter is set at 16 mm-22 mm, so that the reverse crown amount ΔR2 can be set at about 1 mm-3 mm.

However, the stretching roller 22 may desirably be formed so that, the reverse crown amount ΔR2 thereof falls within a range of ±0.2 mm from a predetermined reference value ΔR2*a*. The reference value ΔR2*a* is a reverse crown amount in which the secondary transfer belt 12 is stretchable so that a circumferential length of the secondary transfer belt 12 at each of the end portions and a circumferential length of the secondary transfer belt 12 at the central portion are equal to each other. In this embodiment, the stretching roller 22 is formed so that a difference between the reverse crown amount ΔR2 and the reference value ΔR2*a* falls within ±0.2 mm.

$$\Delta R2 - \Delta R2a \leq 10.21 \quad \text{(absolute value)}$$

That is, when the stretching roller 22 is formed so that the difference between the reverse crown amount ΔR2 and the reference value ΔR2*a* is within ±0.2 mm, the secondary transfer belt 12 is stretched in a state in which the circumferential lengths of the secondary transfer belt 12 at each of the end portions and at the central portion are equal to each other.

As described above, the stretching roller 22 which is an example of a stretching roller stretches the secondary transfer belt 12 in the downstream side of the feeding surface forming roller 21 with respect to the rotational direction of the secondary transfer belt 12. At each of the end portions with respect to the rotational axis direction, the stretching roller 22 has a region where the secondary transfer belt 12 is stretched in a diameter larger than a diameter at the central portion. The diameters of the stretching roller 22 at the end portions and the central portion with respect to the rotational axis direction are set so that a circumferential length of a portion where the secondary transfer belt 12 is stretched at each of the end portions of the feeding surface forming roller 21 with respect to the rotational axis direction and a circumferential length of a portion where the secondary transfer belt 12 is stretched at the central portion of the feeding surface forming roller 21 with respect to the rotational axis direction are equal to each other.

(Hermetical Contact Condition)

As shown in FIG. 2, on the peripheral surface of the stretching roller 22 disposed downstream of the feeding surface forming roller 21, the reverse crown shape is formed so as to cancel a difference in circumferential length of a rotational orbit, between the central portion and each of the end portions of the feeding surface forming roller 21, caused by the peripheral surface of the feeding surface forming roller 21 having the normal crown shape.

As shown in FIG. 3, a contact angle between the secondary transfer belt 12 and the feeding surface forming roller 21 is θ1, and a contact angle between the secondary transfer belt 12 and the stretching roller 22 is θ2. As described above, the normal crown amount of the feeding surface forming roller is ΔR1, and the reverse crown amount of the stretching roller 22 is ΔR2. At this time, in order to extend the secondary transfer belt 12 in a tension state along the peripheral surface of the feeding surface forming roller 21 having the normal crown shape, the parameters ΔR1, ΔR2, θ1 and θ2 may desirably satisfy the following relationship.

$$\Delta R1\times\theta1\leq\Delta R2\times\theta2$$

That is, when the difference between the maximum outer diameter and the minimum outer diameter of the feeding surface forming roller 21 is ΔR1, the angle of winding of the secondary transfer belt 12 about the feeding surface forming roller 21 is θ1, the difference between the maximum outer diameter and the minimum outer diameter of the stretching roller 22 is ΔR2, and the angle of winding of the secondary transfer belt 12 about the stretching roller 22 is θ2, the relationship of: ΔR1×θ1≤ΔR2×θ2 may desirably be satisfied.

In the case where the amount in which each of the end portions of the secondary transfer belt 12 is deformed larger than the central portion of the secondary transfer belt 12 by the stretching roller 22 having the reverse crown shape is equal to or larger than the amount in which the central portion of the secondary transfer belt is curved (convexed) outward by the feeding surface forming roller 21 having the normal crown shape, even when the secondary transfer belt 12 is formed of the hard material such as the resin material, by the force for stretching the secondary transfer belt 12 in the end portion direction by the stretching roller 22, the secondary transfer belt 12 can be stretched along over the entire longitudinal direction of the feeding surface forming roller 21. For this reason, the above-described relationship may desirably be satisfied.

(Comparison Experiment)

Secondary transfer belt units 36 were prototyped while changing shapes of peripheral surfaces of the secondary transfer roller 10, the feeding surface forming roller 21, the stretching roller 22 and the driving roller 23. Then, each of the prototyped secondary transfer belt units 36 was mounted in the image forming apparatus 100, and then a crease generation state of the recording material in an operation in a double-side printing mode of thin paper was compared. This is because an amount of the crease generation on the recording material is larger in the operation in the double-side printing mode as described later. Incidentally, most of the secondary transfer rollers 10 are formed in a slightly normal crown shape as described above, but are represented by "straight" in substantial meaning in Tables 1 and 2.

TABLE 1

| Roller | EMB. 1 | EMB. 2 |
|---|---|---|
| STR*1 | Straight | Straight |
| FSFR*2 | NCS*6 | NCS*6 |
| SR*3 | RCS*7 | Straight |
| DR*4 | Straight | Straight |
| CPE*5 | A | B |

*1"STR" is the secondary transfer roller.
*2"FSFR" is the feeding surface forming roller.
*3"SR" is the stretching roller.
*4"DR" is the driving roller.
*5"CPE" is the crease preventing effect.
*6"NCS" is the normal crown shape.
*7"RCS" is the reverse crown shape.

As shown in Table 1, in the cases of the Embodiments 1 and 2 in which the peripheral surface of the feeding surface forming roller 21 was formed in the normal crown shape, the recording material crease preventing effect in the operation in the double-side printing mode of the thin paper was obtained ("A" and "B"). Particularly, in Embodiment 1 in which the peripheral surface of the stretching roller 22 was formed in the reverse crown shape, a large recording material crease preventing was obtained ("A").

TABLE 2

| Roller | CE1 | CE2 | CE3 | CE4 | CE5 |
|---|---|---|---|---|---|
| STR*1 | RCS*7 | Straight | Straight | Straight | Straight |
| FSFR*2 | Straight | Straight | RCS*7 | RCS*7 | RCS*7 |
| SR*3 | Straight | Straight | Straight | Straight | NCS*6 |
| DR*4 | Straight | Straight | Straight | Straight | Straight |
| CPE*5 | C | C | D | D | E |

*1"STR" is the secondary transfer roller.
*2"FSFR" is the feeding surface forming roller.
*3"SR" is the stretching roller.
*4"DR" is the driving roller.
*5"CPE" is the crease preventing effect.
*6"NCS" is the normal crown shape.
*7"RCS" is the reverse crown shape.

Comparison Example 1 ("CE1") corresponds to a conventional constitution in the case where there is no secondary transfer belt 12, and in the case where there is no secondary transfer belt 12, the large recording material crease preventing effect is obtained. However, in a state in which the secondary transfer belt 12 was stretched, the crease prevention effect disappeared ("C").

In Comparison Example 2 ("CE2"), there was no crease preventing effect ("C"). In Comparison Example 3 ("CE3"), Comparison Example 4 ("CE4") and Comparison Example 5 ("CE5"), the opposite effect was obtained, so that the generation of the creases was conspicuous ("D" and "E" (more conspicuous)).

Accordingly, by forming the peripheral surface of the feeding surface forming roller 21 in the normal crown shape, the crease prevention effect is obtained, and the crease preventing effect is enhanced by forming the peripheral surface of the stretching roller 22 in the reverse crown shape.

(Supplemental Description of Comparison Example 1)

In the image forming apparatus described in JP-A 2011-123254, in order to alleviate a degree of Waving of the recording material generated in the fixing device, the recording material after the fixing is quickly cooled. However, when a system for quickly cooling the recording material is intended to be provided, a large scale cooling device is needed, and therefore production and operation costs are increased, so that there arise such problems that the image forming apparatus is upsized and power consumption is increased.

In the image forming apparatus described in JP-A Hei 7-225523, the peripheral surface of the transfer roller for forming the transfer position for the toner image is formed into the reverse crown shape, so that such a feeding speed distribution that the end portions of the recording material with respect to the widthwise direction are urged outward is generated at the secondary transfer portion T2. As a result, the creases of the recording material can be smoothed down outward at the secondary transfer portion and the nip of the fixing device.

Accordingly, in the case where the peripheral surface of the secondary transfer roller 10 is formed in the reverse crown shape as in Comparison Example 1 described above, even when the recording material P on which the waving generates in the fixing device 60 is used, it would be expected that the creases do not generate when the recording material P passes through the secondary transfer portion T2. However, as described above, in Comparison Example 1, such an effect is not obtained. The reason therefor would be considered as follows.

In order to stably feed the recording material P, in the case where the secondary transfer belt 12 is tightly extended about the surface of the secondary transfer roller 10, the secondary transfer belt 12 is flatly deformed by the tension for stretching the secondary transfer belt 12 and by the inner secondary transfer roller 42 opposing the secondary transfer roller 10. For this reason, such a speed distribution that the creases of the recording material are smoothened down cannot be formed.

That is, in the case where the secondary transfer belt is stretched by the secondary transfer roller having the reverse crown shape on the peripheral surface, the creases of the paper cannot be sufficiently smoothened down by the reverse crown shape of the secondary transfer roller.

The transfer non-uniformity due to the creases is liable to generate at the secondary transfer portion T2 due to the waving generated in the fixing device 60.

On the other hand, in First Embodiment, even in the case where the creases of the recording material cannot be sufficiently smoothened down by the shape of the peripheral surface of the secondary transfer roller 10 at the secondary transfer portion T2, the creases generating at the secondary transfer portion T2 are prevented, so that a high-quality resulting product can be outputted.

(Operation in Double-Side Printing Mode of Thin Paper)

Figure 5:
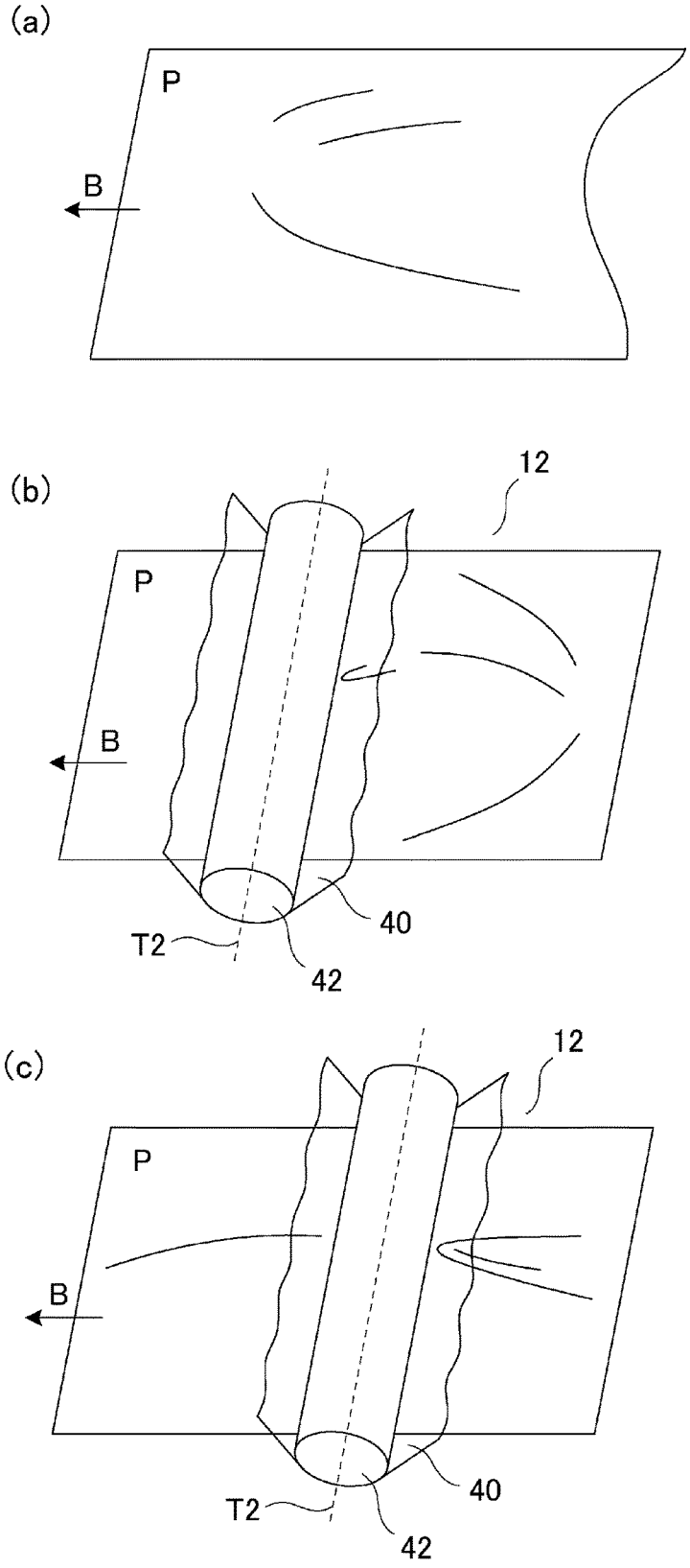
In FIG. 5, (a), (b) and (c) are illustrations of generation of creases on a recording material in an operation in a double-side printing mode of thin paper.

In FIG. 5, (a) to (c) are illustrations of generation of creases on the recording material in an operation in a double-side printing mode of thin paper. As shown in FIG. 1, in the operation in the double-side printing mode, when heat and pressure are applied to the recording material P by the fixing device 60 in order to fix the toner image on a first surface (front surface) of the recording material P, water content (moisture) is taken from the recording material P containing a certain amount of the water content, and thereafter the recording material P quickly absorbs the water contents from an ambience. A change in water content in the recording material P abruptly generates before and after the recording material P passes through the fixing device 60, so that fibers of the paper as the recording material P partly expand and contract and thus waving generates on the recording material P in some cases. The change in water content is conspicuous at the end portions more than at the central portion, and therefore a phenomenon, that the end portions of the recording material are longer than the central portion and become wavy, which is called waving is liable to generate on the recording material P passing through the fixing device 60.

Further, in the case where the recording material P is fed again to the secondary transfer portion T2 in order to transfer the recording material P onto the back surface of the recording material P on which the waving has been generated, wavy portions of the recording material P at the end portions move toward the central portion so as to match the lengths at the end portions with the length at the central portion, and change into the creases when the recording material P passes through the secondary transfer portion T2. In the case where conspicuous creases generate at the secondary transfer portion T2, when the recording material is remarkably brittle (fragile), the recording material itself is folded at folds of the creases. Even when the recording material is not of such an extent that the recording material is folded, the transfer non-uniformity of the toner image generates between the portion where the creases are generated and the portion where the creases are not generated, and therefore a quality of an output image is impaired certainly. The waving of the recording material generating in the fixing device 60 becomes more conspicuous with thin paper having lower rigidity, and the transfer non-uniformity due to the creases at the secondary transfer portion T2 generated by the waving is more liable to generate with thinner paper.

As shown in (a) of FIG. 5, on the recording material P, the waving is generated longer at the central portion with respect to the recording material feeding direction perpendicular to the widthwise direction than at each of the end portions with respect to the recording material feeding direction. As shown in (b) of FIG. 5, when the recording material P on which the waving is generated is attracted to the flat secondary transfer belt 12, due to a difference in length with respect to the recording material feeding direction between the central portion and each of the end portions, the central portion of the recording material with respect to the widthwise direction bulges upward so as to be separated from the secondary transfer belt 12. When the recording material P is fed to the secondary transfer portion T2 while being kept in a state in which the central portion of the recording material P with respect to the widthwise direction bulges, the bulging central portion with respect to the widthwise direction is gradually shifted toward an upstream side opposite to a recording material feeding direction B. As shown in (c) of FIG. 5, when the bulging central portion with respect to the widthwise direction cannot withstand nip pressure at the secondary transfer portion T2, the bulging central portion with respect to the widthwise direction is squashed by the nip pressure to generate the creases.

As described above, in this embodiment, even when the waving generates, in order to prevent generation of the creases on the recording material P, the feeding surface forming roller is formed in the normal crown shape and the stretching roller 22 is formed in the reverse crown shape. In this case, by an experiment described later, it was confirmed that the creases are generated to a lesser extent with a larger difference in winding length of the secondary transfer belt 12 about the feeding surface forming roller 21 between the central portion of the feeding surface forming roller 21 and each of the end portions of the feeding surface forming roller 21. Table 3 shows a relationship, between an expansion amount and the occurrence or nonoccurrence of an image defect, obtained by the experiment. In Table 3, the case where the image defect occurs is represented by "x", and the case where the image defect does not occur is represented by "o". The expansion amount is a deformation amount of the recording material P in the case where the recording material P is extended and deformed outward with respect to the widthwise direction (perpendicular to the recording material feeding direction) in the position upstream of the secondary transfer portion T2 during the transfer. As can be understood from Table 3, in the case where the expansion amount is 3 mm or more, an image defect does not occur.

TABLE 3

| EA*1 (mm) | 0 | 2 | 3 | 4 | 6 |
|---|---|---|---|---|---|
| ID*2 | x | x | ○ | ○ | ○ |

*1"EA" is the expansion amount.
*2"ID" is the image defect.

Figure 6:
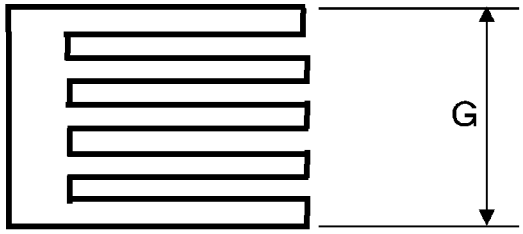
In FIG. 6, (a) and (b) are schematic views for illustrating an expansion amount.
Figure 6:
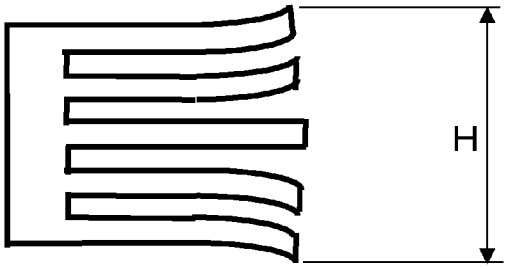

The expansion amount will be described with reference to FIG. 6. In FIG. 6, (a) shows a state of the recording material P before the recording material P is passed through the secondary transfer portion T2 (before the passing), and (b) shows a state of the recording material P after the recording material P is passed through the secondary transfer portion T2 (after the passing). As the recording material P, as shown in (a) of FIG. 6, an A3-sized sheet cut in a rectangular strip shape (in which adjacent rectangular strips are spaced by an opening) along the recording material feeding direction in a trailing end side was used. In this case, the number of rectangular strips is 5, the opening between the adjacent rectangular strips is 20 mm, and a length of each of the rectangular strips is 200 mm. When this sheet passes through the secondary transfer portion T2, as shown in (b) of FIG. 6, in the trailing end side of the sheet, the sheet extends outward with respect to the widthwise direction of the sheet. Widths of the sheet before and after the sheet is passed through the secondary transfer portion T2 were measured, and a difference between a trailing end width G of the sheet before the sheet is passed through the secondary transfer portion T2 and a trailing end width H of the sheet after the sheet is passed through the secondary transfer portion T2 was used as the expansion amount.

Figure 7:
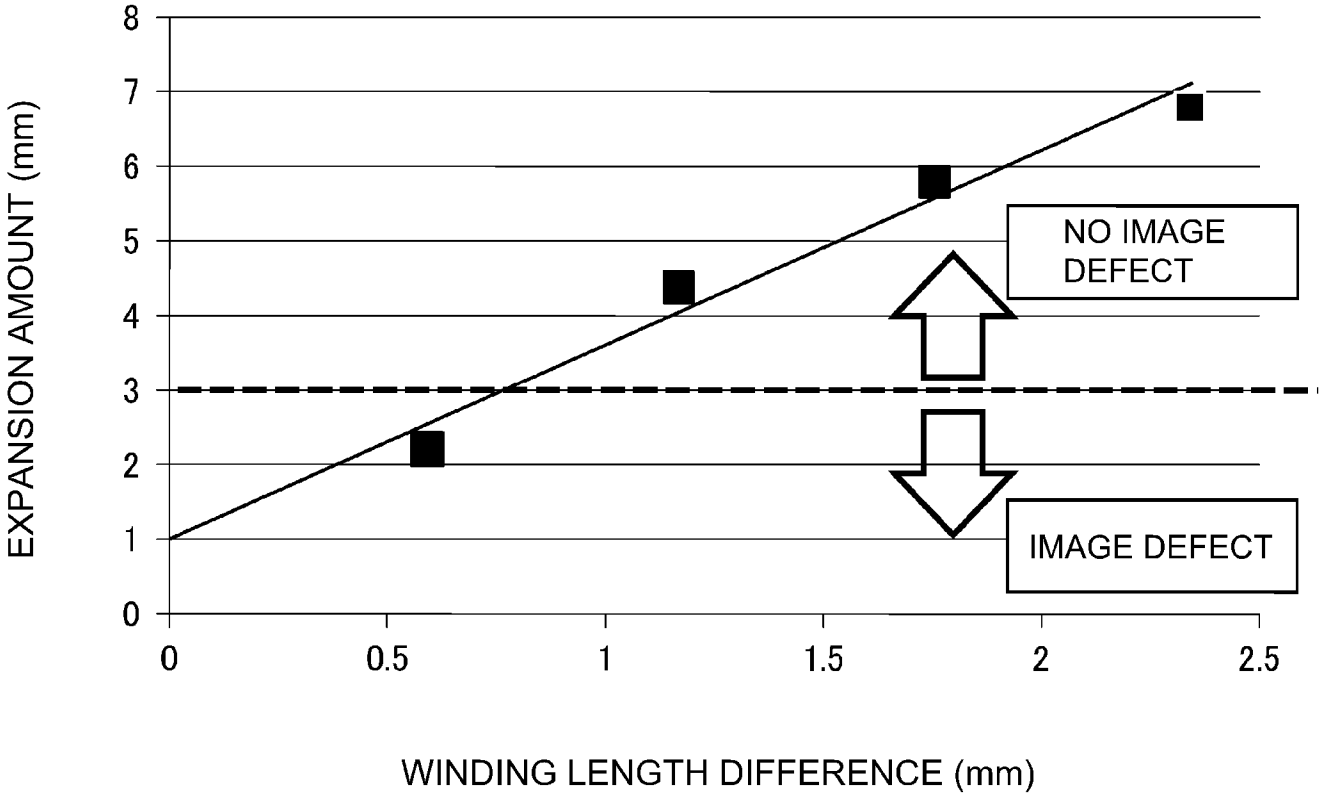
FIG. 7 is a graph showing a relationship between the expansion amount, a difference in winding length and occurrence or nonoccurrence of an image defect.

Then, the above-described sheet was passed through the secondary transfer portion T2 while changing the difference in winding length of the secondary transfer belt 12, and thereafter the expansion amount and the occurrence or nonoccurrence of the image defect at each time of measurement were checked. An experimental result is shown in FIG. 7. FIG. 7 shows the relationship, obtained by the experiment, between the difference in winding amount and the expansion amount. Further, FIG. 7 also shows a relationship between the expansion amount and the occurrence or nonoccurrence of the image defect. As shown in FIG. 7, in the case where the expansion amount is larger than a predetermined value (3 mm in this case), the image defect did not occur. Further, the case where the expansion amount became larger than the predetermined value (3 mm) was the case where the winding length difference was larger than 0.8 mm. As a result, it can be understood that the image defect is liable to occur in the case where the winding length difference is 0.8 mm or less and does not readily occur in the case where the winding length difference is larger than 0.8 mm. In other words, it can be said that the crease smoothing-down effect on the recording material is readily obtained in the case where the winding length difference is made larger than 0.8 mm.

Figure 8:
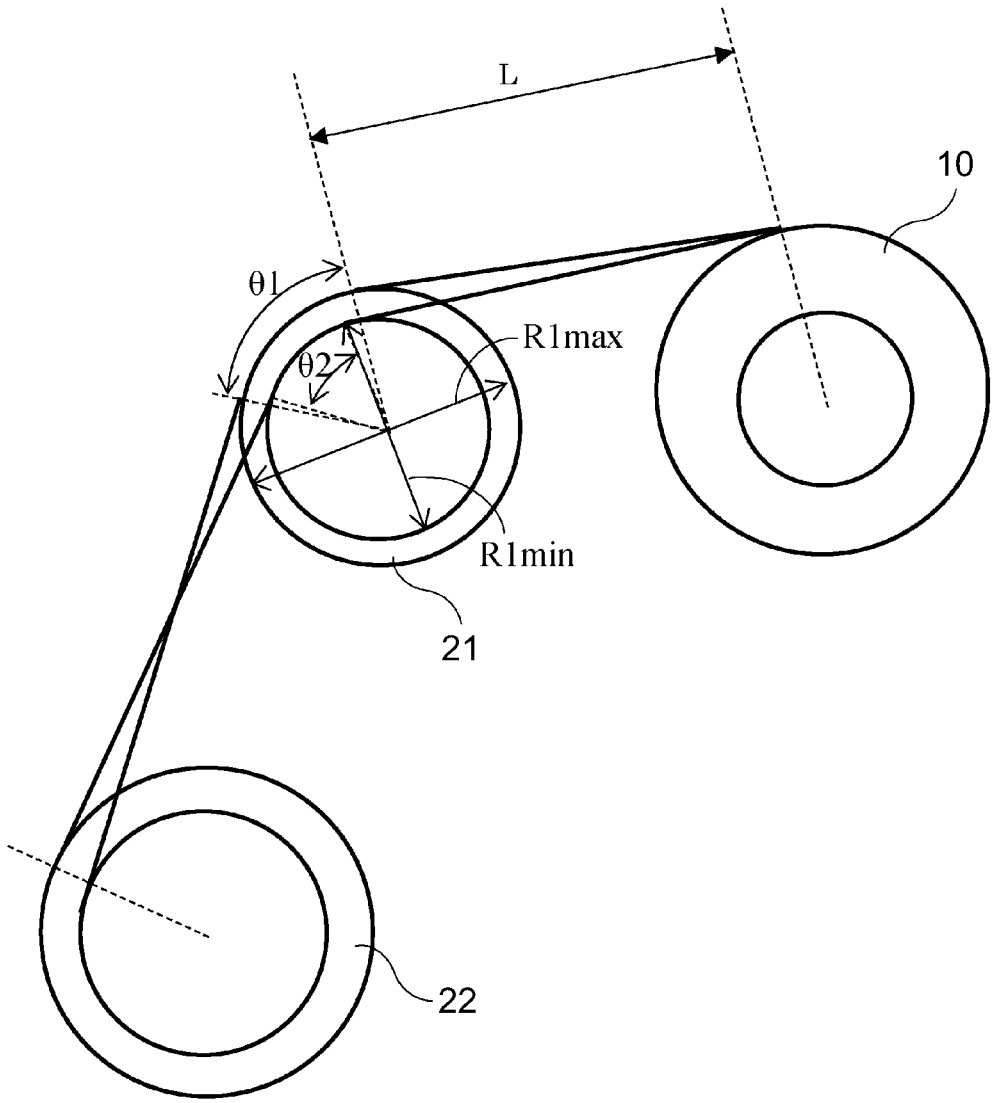
FIG. 8 is a schematic view for illustrating the winding length.

The winding length of the secondary transfer belt 12 will be described with reference to FIG. 8. As shown in FIG. 8, in this embodiment, with respect to the rotational axis direction, an outer diameter of a portion of the feeding surface forming roller 21 having the largest outer diameter is R1max, and an outer diameter of a portion of the feeding surface forming roller 21 having the smallest outer diameter is R1min. Further, an angle of winding of the secondary transfer belt 12 about the feeding surface forming roller 21 at the central portion with respect to the rotational axis direction is θ1, and an angle of winding of the secondary transfer belt 12 about the feeding surface forming roller 21 at each of the end portions with respect to the rotational axis direction is θ3. In this case, the winding lengths at the central portion and each of the end portions are represented by "(R1max/2)×θ1" and "(R1min/2)×θ3", respectively.

As described above, when the difference between these winding lengths is larger than 0.8 mm, the crease smoothing-down effect on the recording material P is obtained. That is, in order to suppress the generation of the creases, R1max, R1min, θ1 and θ3 may only be required to satisfy the following relationship:

$$0.8<\{(R1max/2)\times\theta1-(R1min/2)\times\theta3\}.$$

The crease smoothing-down effect is larger with a larger difference in winding length described above. Therefore, it would be considered that the winding length difference is made larger by winding the secondary transfer belt 12 about the feeding surface forming roller 21 in a larger amount. However, in the case where the secondary transfer belt 12 is wound in a large amount about the feeding surface forming roller 21 having the normal crown shape, rotation of the feeding surface forming roller 21 is impaired and the secondary transfer belt 12 is broken in some cases. Therefore, stress exerted on the secondary transfer belt 12 is taken into account and in order to obtain a larger crease smoothing-down effect, in this embodiment, R1max, R1min, θ1 and θ3 are further required to satisfy the following relationship:

$$E/F>16.3\times\{(R1max/2)\times\theta1-(R1min/2)\times\theta3\}-2.4.$$

In the above relationship, E (MPa) is a yield strength of the secondary transfer belt 12, and F (kg) is a tension applied to the secondary transfer belt 12.

Figure 9:
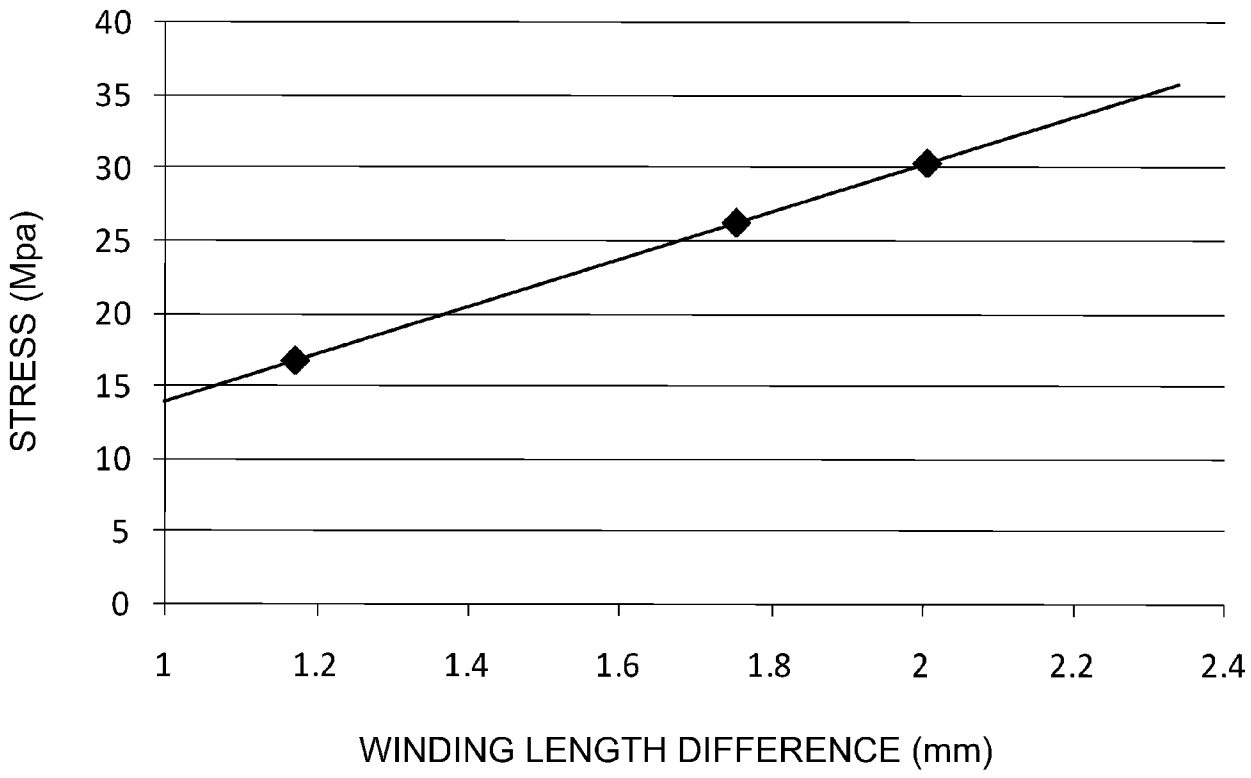
FIG. 9 is a graph showing a relationship between the difference in winding length and stress.

The above relationship can be obtained by subjecting the experimental result shown in FIG. 9 to numerical analysis. FIG. 9 shows a relationship, obtained by an experiment, between the winding length difference of the secondary transfer belt 12 and a maximum stress exerted on the secondary transfer belt 12. By analyzing the experimental result shown in FIG. 9, an approximated curve showing the relationship between the maximum stress Em (MPa) and the winding length difference (mm) was obtained. This approximated curve is represented by the following approximate expression:

$$Em=16.3\times\{(R1max/2)\times\theta1-(R1min/2)\times\theta3\}-2.4.$$

Thus, it is understood that the tension F (kg) and the maximum stress Em (MPa) are in a proportional relationship. Therefore, when the above-described approximate expression is divided by the tension F (kg), the following equation is derived.

$$Em/F=16.3\times\{(R1max/2)\times\theta1-(R1min/2)\times\theta3\}-2.4.$$

Further, the yield strength E (MPa) of the secondary transfer belt 12 is required to be larger than the maximum stress Em (MPa). From the above, the relational expression described above is obtained. The relational expression shows an upper limit of the winding length difference of the secondary transfer belt 12.

$$E/F>16.3\times\{(R1max/2)\times\theta1\times(R1min/2)\times\theta3\}-2.4.$$

In this embodiment, the yield strength E (MPa) of the secondary transfer belt 12 is 100 MPa-150 MPa. Further, the tension F (kg) is 1.5 kg-4 kg.

In this embodiment, the winding length difference may desirably be, e.g., about 1.2 mm. This value is larger than 0.8 mm, and therefore the crease smoothing-down effect on the recording material P is sufficiently obtained. Further, in this case, the stress exerted on the secondary transfer belt 12 is smaller than the yield strength of the secondary transfer belt 12. For that reason, the rotation of the secondary transfer belt 12 is not impaired, and the secondary transfer belt 12 is not broken.

The feeding surface forming roller 21 also functions as the separation roller for forming, on the secondary transfer belt 12, a curved surface for curvature-separating the recording material P from the secondary transfer belt 12. In the case where the feeding surface forming roller 21 is formed in the normal crown shape, the thin paper having the low rigidity is fed while being attracted to the secondary transfer belt 12 along the secondary transfer belt 12. However, thick paper having a high rigidity is not fed along the secondary transfer belt 12, but is separated from the secondary transfer belt 12, and therefore the thick paper cannot be fed by the secondary transfer belt 12 at the position downstream of the feeding surface forming roller 21. When stable feeding of the recording materials P, including the thin paper to the thick paper, to the fixing device 60 is taken into consideration, it is desirable that the feeding surface forming roller 21 functions also as the separation roller, and then the recording material P is fed to the fixing device 60 by the pre-feeding device 61 for the fixing device 60.

(Effect of First Embodiment)

In First Embodiment, the peripheral surface of the feeding surface forming roller 21 disposed downstream of the secondary transfer portion T2 is deformed in the normal crown shape so that the central portion of the secondary transfer belt 12 with respect to the widthwise direction is curved outward more than at each of the end portions of the secondary transfer belt 12 with respect to the widthwise direction, and therefore the creases do not readily generate on the recording material. Even when the thin paper is used as the recording material, the creases do not readily generate on the recording material even in an operation in the double-side printing mode. By forming the peripheral surface of the feeding surface forming roller 21 in the normal crown shape, the recording material P on the secondary transfer belt 12 is deformed so that the recording material is curved outward at a position downstream of the secondary transfer belt T2. When a rigid member such as the paper is sandwiched at the nip as the secondary transfer portion T2, in response to the nip pressure, such a force that the rigid member is curved downward acts on the rigid member in the neighborhood of the secondary transfer portion T2. At a position upstream of the secondary transfer portion T2, this force decreases a degree of the expansion of the recording material, curved upward, causing the creases, and therefore it is possible to suppress the creases generated at the secondary transfer portion T2.

In First Embodiment, the peripheral surface of the stretching roller 22 is deformed in the reverse crown shape so that the central portion of the secondary transfer belt 12 with respect to the widthwise direction is curved inward more than at each of the end portions of the secondary transfer belt 12 with respect to the widthwise direction, and therefore the secondary transfer belt 12 is contacted to the feeding surface forming roller 21 with no gap. The peripheral surface of the stretching roller 22 disposed downstream of the feeding surface forming roller 21 has the reverse crown shape, and therefore even when the secondary transfer belt 12 is a rigid resin belt, the secondary transfer belt 12 is extended around the rollers in a state in which the secondary transfer belt 12 is stretched properly on the peripheral surface of the feeding surface forming roller 21 having the normal crown shape. In this state, the recording material P positioned downstream of the secondary transfer portion T2 is fed along such a shape that the central portion further bulges. For this reason, an effect of forming the peripheral surface of the feeding surface forming roller 21 in the normal crown shape is enhanced, and thus an effect of smoothing down the creases of the recording material P by the feeding surface forming roller 21 becomes conspicuous, so that also an image defect due to the creases resulting from the waving generated in the fixing device 60 is alleviated.

In First Embodiment, the feeding surface forming roller 21 also functions as a separation roller for curvature-separating the recording material P from the secondary transfer belt 12, and therefore there is no need to provide an independent separation roller at a position downstream of the feeding surface forming roller 21. For this reason, the number of components of the secondary transfer belt unit 36 is reduced, so that downsizing of the secondary transfer belt unit 36 is achieved.

From a viewpoint of the reduction in the number of the components, as described in JP-A 2011-123254, it would be considered that a portion from the secondary transfer portion T2 to the fixing device 60 is constituted by a single transfer belt unit. This constitution is such that a feeding surface forming roller is provided downstream of the feeding surface forming roller 21 and the independent separation roller is provided downstream of the feeding surface forming roller. In this case, even when the peripheral surface of the feeding surface forming roller has the normal crown shape, the thin paper having the low rigidity is fed while being attracted to the secondary transfer belt 12 along the secondary transfer belt 12. However, thick paper having a high rigidity is not fed along the secondary transfer belt 12, but is separated from the secondary transfer belt 12, and therefore the thick paper cannot be fed stably at the position downstream of the feeding surface forming roller.

Accordingly, when the recording materials P including the thin paper to the thick paper are intended to be stably fed from the secondary transfer portion T2 to the fixing device 60, as shown in FIG. 1, it is desirable that the feeding surface forming roller 21 is disposed at a position close to the secondary transfer roller 10 while also functioning as the separation roller. In a space from the feeding surface forming roller 21 to the fixing device 60, it is desirable that the recording material P is fed by the pre-feeding device 61, for the fixing device, as another feeding means.

According to First Embodiment, even when the recording material P fed to the secondary transfer portion T2 is in a state in which the recording material P passes through the fixing device 60 once and generates the waving thereon, it is possible to reliably decrease a degree of the image defect due to the creases generated at the secondary transfer portion T2 resulting from the waving.

<Second Embodiment>

Figure 10:
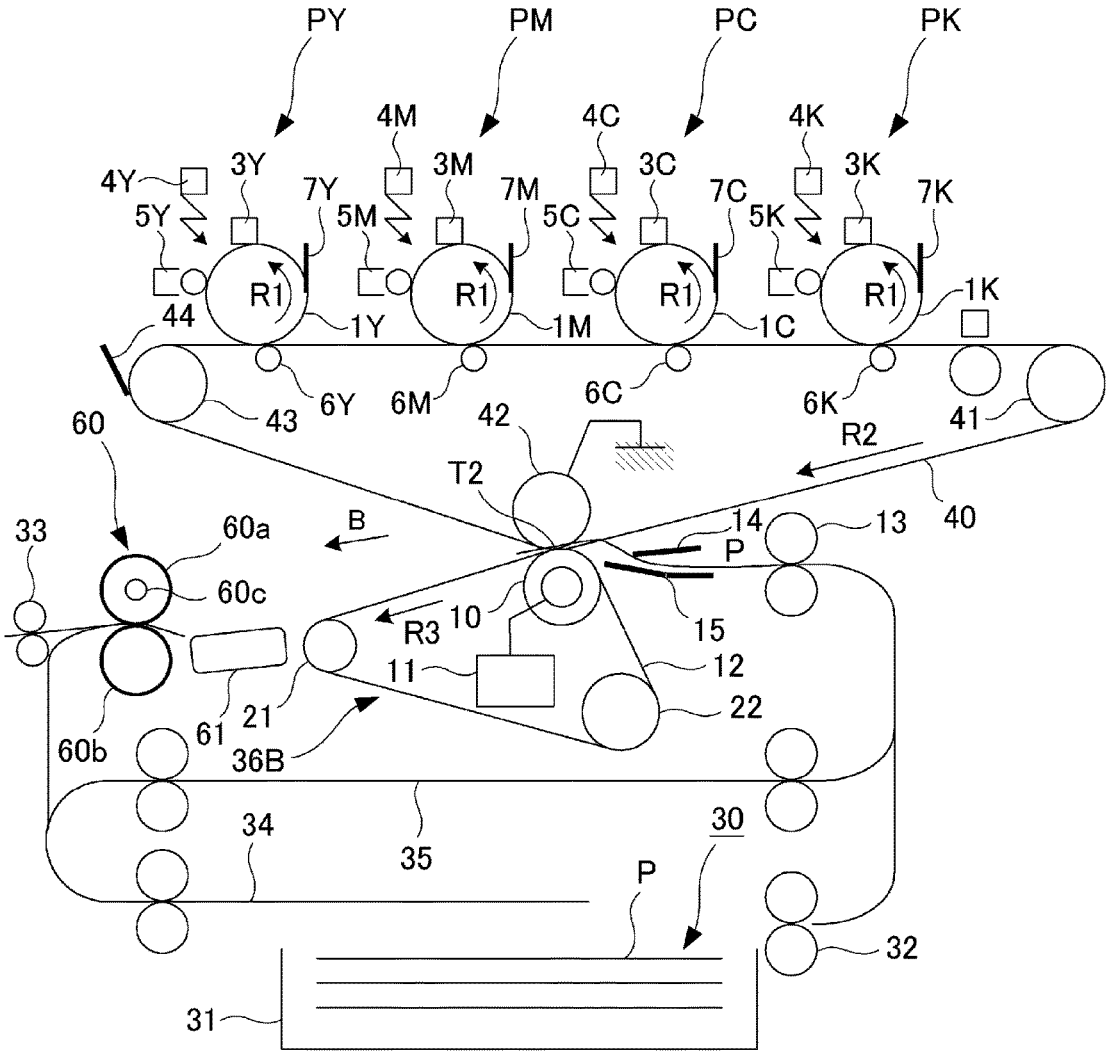
FIG. 10 is an illustration of a structure of an image forming apparatus in Second Embodiment.

FIG. 10 is an illustration of a structure of an image forming apparatus in Second Embodiment. As shown in FIG. 1, in First Embodiment, the secondary transfer belt 12 was stretched in a trapezoidal shape by the four stretching rollers. On the other hand, in Second Embodiment, the secondary transfer belt 12 is stretched in a triangular shape by three stretching rollers. Constitutions other than a stretching shape of the secondary transfer belt 12 and the number of the stretching rollers are similar to those in First Embodiment, and therefore in the following description, constituent elements common to First and Second Embodiments are represented by the same reference numerals or symbols as those in FIG. 1 and will be omitted from redundant description.

As shown in FIG. 10, the secondary transfer belt 12 of a secondary transfer belt unit 36B is stretched by a feeding surface forming roller 21, a stretching roller 22 and a secondary transfer roller 10. The feeding surface forming roller 21 functioning also as a separation roller for the secondary transfer belt 12 is provided downstream of the secondary transfer roller 10. The stretching roller 22 is provided downstream of the feeding surface forming roller 21. The secondary transfer roller 10 is provided downstream of the stretching roller 22.

In Second Embodiment, the driving roller 23 and the motor M3, for driving the driving roller 23, which are used in First Embodiment are not provided, and the secondary transfer belt 12 is rotated by the intermediary transfer belt 40 in contact with the intermediary transfer belt 40.

As shown in (a) of FIG. 4, the feeding surface forming roller 21 has the normal crown shape on the peripheral surface thereof. When an outer diameter of the feeding surface forming roller 21 at a portion having the largest outer diameter is R1max and an outer diameter of the feeding surface forming roller 21 at a portion having the smallest outer diameter is R1min, a normal crown amount ΔR1 is defined as follows.

$$\Delta R1 = R1\text{max} - R1\text{min}$$

In Second Embodiment, R1min is 10 mm-16 mm, and ΔR1 is about 1 mm-3 mm.

As shown in (b) of FIG. 4, the stretching roller 22 has the reverse crown shape on the peripheral surface thereof. When an outer diameter of the stretching roller 22 at a portion having the largest outer diameter is R1max and an outer diameter of the stretching roller 22 at a portion having the smallest outer diameter is R2min, a reverse crown amount ΔR2 is defined as follows.

$$\Delta R2 = R2\text{max} - R2\text{min}$$

In Second Embodiment, R2min is 16 mm-22 mm, and ΔR2 is about 1 mm-3 mm.

The feeding surface forming roller 21 also functions as the separation roller for forming, on the secondary transfer belt 12, a curved surface for curvature-separating the recording material P from the secondary transfer belt 12. In the case where the peripheral surface of the feeding surface forming roller 21 has the normal crown shape, the thin paper having the low rigidity is fed while being attracted to the secondary transfer belt 12 along the secondary transfer belt 12. However, thick paper having a high rigidity is not fed along the secondary transfer belt 12, but is separated from the secondary transfer belt 12, and therefore the thick paper cannot be fed stably by the secondary transfer belt 12 at the position downstream of the feeding surface forming roller 21. When stable feeding of the recording materials P, including the thin paper to the thick paper, to the fixing device 60 is taken into consideration, it is desirable that the feeding surface forming roller 21 functions as the separation roller, and then the recording material P is fed to the fixing device 60 by the pre-feeding device 61 for the fixing device.

The stretching roller 22 disposed downstream of the feeding surface forming roller 21 having the normal crown shape has the reverse crown shape, and therefore even when the secondary transfer belt 12 is a hard resin belt, the secondary transfer belt 12 is extended around the stretching rollers in a state in which the secondary transfer belt 12 is stretched properly by the feeding surface forming roller 21.

In Second Embodiment, the number of components for the secondary transfer belt unit 36B is smaller than that in First Embodiment, and therefore the secondary transfer belt unit 36B can be manufactured inexpensively. A simple system in which the secondary transfer roller 10 is disposed downstream of the stretching roller 22 is employed, but similarly as in First Embodiment, the generation of the creases at the secondary transfer portion T2 can be suppressed.

Even when the recording material P fed to the secondary transfer portion T2 is in a state in which the recording material P passes through the fixing device 60 and generates the waving thereon, it is possible to decrease a degree of the image defect due to the creases generated at the secondary transfer portion T2 resulting from the waving. Accordingly, in order to prevent the generation of the creases due to the waving at the secondary transfer portion T2, the stretching rollers other than the secondary transfer roller 10 may also be two stretching rollers.

<Other Embodiments>

Figure 11:
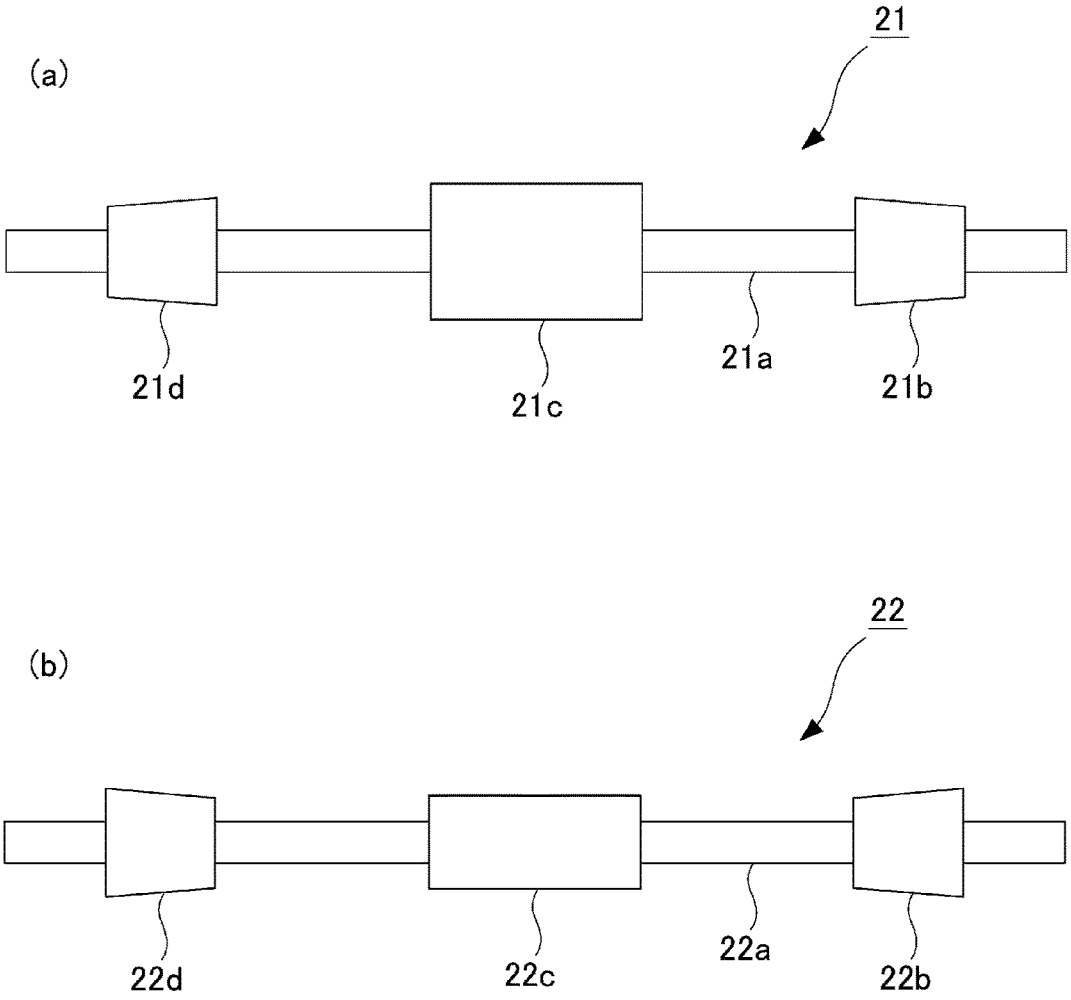
In FIG. 11, (a) and (b) are illustrations of an example of other embodiments.

In FIG. 11, (a) and (b) are illustrations of an example of other embodiments. The present invention is not limited to the constitutions, the control, the materials, the design and the dimensions described in First and Second Embodiments. In the secondary transfer belt unit 36 shown in FIG. 1, the number of the stretching rollers excluding the secondary transfer roller 10 may also be 4 or more. The feeding surface forming roller 21 is not required to function also as the separation roller. The constitution of First Embodiment is not a constitution which achieves the effect only in the transfer of the toner image on the second surface (back surface) in the operation in the double-side printing mode.

As shown in (a) of FIG. 11, the feeding surface forming roller 21 is not limited to one having the shape in which the diameter continuously changes with respect to the rotational axis direction and one having the normal crown shape on the peripheral surface thereof. A contour shape of the feeding surface forming roller 21 deformable so that the central portion of the secondary transfer belt 12 with respect to the widthwise direction is curved outward more than at each of the end portions of the secondary transfer belt 12 with respect to the widthwise direction is not limited to the normal crown shape. At end portions of a stainless steel center shaft 21*a*, resin rollers 21*b* and 21*d* may be fixed, and at a central portion of the center shaft 21*a*, a resin roller 21*c* may be fixed.

As shown in (b) of FIG. 11, the stretching roller 22 is not limited to one having the shape in which the diameter continuously changes with respect to the rotational axis direction and one having the reverse crown shape on the peripheral surface thereof. A contour shape of the stretching roller 22 deformable so that the central portion of the secondary transfer belt 12 with respect to the widthwise direction is curved inward more than at each of the end portions of the secondary transfer belt 12 with respect to the widthwise direction is not limited to the reverse crown shape. At end portions of a stainless steel center shaft 22*a*, resin rollers 22*b* and 22*d* may be fixed, and at a central portion of the center shaft 22*a*, a resin roller 22*c* may be fixed.

The image bearing member for carrying the toner image thereon and for transferring the toner image onto the recording material P carried on the secondary transfer belt 12 is not limited to the intermediary transfer belt 40 which is merely an example of the image bearing member. The toner image may also be transferred from the photosensitive drum, which is another example of the image bearing member, onto a transfer belt corresponding to the secondary transfer belt 12 by bringing the photosensitive drum into contact with the transfer belt.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-076284 filed on Apr. 2, 2014, 2015-011256 filed on Jan. 23, 2015 and 2015-034920 filed on Feb. 25, 2015, which are hereby incorporated by reference herein in their entirety.

What is claimed is:

1. An image forming apparatus comprising:

an image bearing member;

a toner image forming unit configured to form a toner image on said image bearing member;

a first transfer belt onto which the toner image is transferred from said image bearing member;

a second transfer belt configured to feed a recording material, wherein said second transfer belt forms a transfer nip, where the toner image is transferred from said first transfer belt onto the recording material, in cooperation with said first transfer belt;

a transfer roller, urged from an inner peripheral surface of said second transfer belt toward said second transfer belt, configured to form a transfer portion for electrostatically transferring the toner image from said first transfer belt onto the recording material;

a power source configured to apply an electric field to the transfer portion;

a first roller configured to wind said second transfer belt about said first roller to form a recording material feeding surface on said second transfer belt between said transfer roller and said first roller, wherein said first roller is provided on an inner peripheral surface of said second transfer belt and disposed at a position downstream of said transfer roller with respect to a traveling direction of said second transfer belt, wherein said first roller has such a shape that a diameter at each of end portions is smaller than a diameter at a central portion with respect to a rotational axis direction;

a second roller configured to wind said second transfer belt about said second roller, wherein said second roller is provided on the inner peripheral surface side of said second transfer belt and disposed at a position adjacent to and downstream of said first roller with respect to the traveling direction of said second transfer belt, and wherein said second roller has such a shape that a diameter at each of end portions is larger than a diameter at a central portion with respect to the rotational axis direction; and a driving roller configured to wind said second transfer belt about said driving roller, and configured to impart a driving force to said second transfer belt, wherein said driving roller is provided on the inner peripheral surface side of said second transfer belt and disposed at a position adjacent to and downstream of said second roller with respect to the traveling direction of said second transfer belt and has such a shape that a diameter is substantially the same along the rotational axis direction.

2. An image forming apparatus according to claim 1, wherein when said second transfer belt is stretched by a plurality of rollers including said first roller and said second roller, the shapes of said first roller and said second roller are set so that, with respect to a first arbitrary cross-section perpendicular to the rotational axis direction of said first roller, said first roller and said second transfer belt contact each other to provide a first peripheral length, and said second roller and said second transfer belt contact each other to provide a second peripheral length, a sum of the first and second peripheral lengths being a first value, with respect to a second arbitrary cross-section perpendicular to the rotational axis direction of said first roller, said first roller and said second transfer belt contact each other to provide a third peripheral length, and said second roller and said second transfer belt contact each other to provide a fourth peripheral length, a sum of the third and fourth peripheral lengths being a second value, and the first value and the second value are substantially the same.

3. An image forming apparatus according to claim 1, wherein when a maximum outer diameter of said first roller is R1max (mm), a minimum outer diameter of said first roller is R1min (mm), an angle of winding of said second transfer belt about said first roller at the central portion with respect to the rotational axis direction is θ1 (rad), and an angle of winding of said second transfer belt about said first roller at each of the end portions with respect to the rotational axis direction is θ3 (rad), the following relationship is satisfied:

$$0.8(\mathrm{mm})<\{(R1\mathrm{max}/2)\times\theta 1-(R1\mathrm{min}/2)\times\theta 3\}.$$

4. An image forming apparatus according to claim 3, wherein when a yield strength of said transfer belt is E (MPa) and a tension applied to said transfer belt is F (kg), the following relationship is satisfied:

$$E/F>16.3(\mathrm{MPa}/(\mathrm{kg}\cdot\mathrm{mm}))\times\{(R1\mathrm{max}/2)\times\theta 1-(R1\mathrm{min}/2)\times\theta 3\}-2.4(\mathrm{MPa}/\mathrm{kg}).$$

5. An image forming apparatus according to claim 1, wherein said first roller has such a normal crown shape that the diameter continuously decreases from the central portion toward each of the end portions with respect to the rotational axis direction, and wherein said second roller has such a reverse crown shape that the diameter continuously increases from the central portion toward each of the end portions with respect to the rotational axis direction.

6. An image forming apparatus according to claim 1, wherein said second transfer belt includes a layer formed of a resin material or a metal material.

7. An image forming apparatus according to claim 1, wherein when a maximum outer diameter of said first roller is R1max (mm), a minimum outer diameter of said first roller is R1min (mm), an angle of winding of said second transfer belt about said first roller at the central portion with respect to the rotational axis direction is θ1 (rad), and an angle of winding of said second transfer belt about said first roller at each of the end portions with respect to the rotational axis direction is θ3 (rad), the following relationship is satisfied:

$$0.8(\mathrm{mm})<\{(R1\mathrm{max}/2)\times\theta 1-(R1\mathrm{min}/2)\times\theta 3\}<1.2(\mathrm{mm}).$$

8. An image forming apparatus comprising:

an image bearing member;

a toner image forming unit configured to form a toner image on said image bearing member;

a first transfer belt onto which the toner image is transferred from said image bearing member;

a second transfer belt configured to feed a recording material, wherein said second transfer belt forms a transfer nip, where the toner image is transferred from said first transfer belt onto the recording material, in cooperation with said first transfer belt;

a transfer roller, urged from an inner peripheral surface of said second transfer belt toward said second transfer belt, configured to form a transfer portion for electrostatically transferring the toner image from said first transfer belt onto the recording material;

a power source configured to apply an electric field to the transfer portion;

a first roller configured to wind said second transfer belt about said first roller to form a recording material feeding surface on said second transfer belt between said transfer roller and said first roller, wherein said first roller is provided on an inner peripheral surface of said second transfer belt and disposed at a position downstream of said transfer roller with respect to a traveling direction of said second transfer belt, wherein said first roller has such a shape that a diameter at each of end portions is smaller than a diameter at a central portion with respect to a rotational axis direction; and a second roller configured to wind said second transfer belt about said second roller, wherein said second roller is provided on the inner peripheral surface side of said second transfer belt and disposed at a position adjacent to and downstream of said first roller with respect to the traveling direction of said second transfer belt, and wherein said second roller has such a shape that a diameter at each of end portions is larger than a diameter at a central portion with respect to the rotational axis direction, wherein when a difference between a maximum outer diameter and a minimum outer diameter of said first roller stretching said second transfer belt is $\Delta R1$, an angle of winding of said transfer belt about said first roller at the central portion with respect to the rotational axis direction is $\theta 1$, a difference between a maximum outer diameter and a minimum outer diameter of said second roller stretching said second transfer belt is $\Delta R2$, and an angle of winding of said second transfer belt about said second roller at the central portion with respect to the rotational axis direction is $\theta 2$, the following relationship is satisfied:

$$\Delta R1 \times \theta 1 \leq \Delta R2 \times \theta 2.$$

* * * * *